United States Patent [19]

Breton et al.

[11] Patent Number: 5,002,733

[45] Date of Patent: Mar. 26, 1991

[54] SILICON ALLOYS CONTAINING CALCIUM AND METHOD OF MAKING SAME

[75] Inventors: Ernest J. Breton, Wilmington, Del.; Jan R. Leszcynski; Michael A. Merritt, both of New Haven, W. Va.; John O. Staggers, Dowington, Pa.

[73] Assignee: American Alloys, Inc., New Haven, W. Va.

[21] Appl. No.: 385,678

[22] Filed: Jul. 26, 1989

[51] Int. Cl.[5] ..... C22C 28/00

[52] U.S. Cl. ..... 420/578; 75/327

[58] Field of Search ..... 420/578; 75/327

[56] References Cited

U.S. PATENT DOCUMENTS

| | | | |
|---|---|---|---|
| 2,993,761 | 7/1961 | Erasmus | 75/327 |
| 3,027,227 | 3/1962 | Coxey | 23/88 |
| 3,051,564 | 8/1962 | Drenning | 75/53 |
| 3,272,623 | 9/1966 | Crafts et al. | 420/578 |
| 3,765,875 | 10/1973 | Septier et al. | 420/578 |
| 3,871,869 | 3/1975 | Overdijk | 75/53 |
| 4,093,451 | 6/1978 | Cass et al. | 75/43 |
| 4,139,587 | 2/1979 | Cox | 264/123 |
| 4,148,627 | 4/1979 | Haley | 75/3 |
| 4,162,917 | 7/1979 | McWhorter | 420/21 |
| 4,194,902 | 3/1980 | Gmohling | 75/55 |
| 4,225,343 | 9/1980 | Guarino et al. | 75/256 |
| 4,318,822 | 3/1982 | Braun | 252/189 |
| 4,385,030 | 5/1983 | Dremann | 420/578 |
| 4,395,285 | 7/1983 | Merkert | 75/256 |
| 4,430,118 | 2/1984 | Freissmuth | 75/58 |
| 4,501,593 | 2/1985 | Paersch et al. | 44/23 |
| 4,541,867 | 9/1985 | Neelameggham | 75/58 |
| 4,592,538 | 6/1986 | Wells, III | 266/216 |
| 4,643,768 | 2/1987 | Bruckmann et al. | 420/578 |
| 4,764,211 | 8/1988 | Meichsner et al. | 75/58 |

FOREIGN PATENT DOCUMENTS

| | | |
|---|---|---|
| 1962567 | 7/1970 | Fed. Rep. of Germany . |
| 3232644 | 5/1983 | Fed. Rep. of Germany . |
| 3321683 | 12/1983 | Fed. Rep. of Germany . |
| 157767 | 6/1986 | India . |
| 58-59288 | 4/1983 | Japan . |

OTHER PUBLICATIONS

Kozheunikov et al. "Production of calcium ferrosilicon by a carbothermic method," Sb. Tr., Chelyabinsk, Elektromet. Komb. No. 3 pp. 83–88 1972.

Conkle et al. "Reconstitution of cool and limestone for use in industrial . . . " Proc.—Inst. Briquet. Agglom. Bienn. Conf., vol. date 1983, vol. 18, pp. 33–54.

*Primary Examiner*—R. Dean

*Assistant Examiner*—David W. Schumaker

*Attorney, Agent, or Firm*—Webb, Burden, Ziesenheim & Webb

[57] ABSTRACT

A method of making a silicon alloy, and preferably a ferrosilicon alloy, having a controlled calcium content and optionally rare earth constituents wherein the calcium and rare earth constituents are separately introduced into the ferrosilicon smelting furnace in briquette form. The calcium briquettes comprise a compressed and cured mixture of calcium carbonate, preferably in the form of pulverized limestone, a carbon source, such as carbon black, and a binder. The briquetted calcium carbonate dissociates as it is heated during its descent in the smelting furnace and transforms to calcium oxide. The resultant calcium oxide reacts with the carbon in the briquette in the high temperature smelting zone to yield calcium carbide which then reacts with silica to form calcium silicide which then enters into solution with the molten ferrosilicon alloy. Rare earth oxides are also briquetted in ore form with a binder and charged into the smelting furnace wherein they are reduced by the excess carbon in the furnace charge to provide elemental rare earth constituents of controlled composition in the ferrosilicon alloy.

7 Claims, No Drawings

SILICON ALLOYS CONTAINING CALCIUM AND METHOD OF MAKING SAME

BACKGROUND OF THE INVENTION

The present invention relates generally to the manufacture of silicon alloys for use in metallurgical operations. More particularly, the present invention relates to such silicon alloys, and preferably ferrosilicon alloys, containing controlled amounts of calcium or calcium and a rare earth constituent which are useful in the production of grey cast iron.

It is well known to treat molten iron with a reactive metal such as magnesium to produce a nodular iron and to desulferize iron. It is also known to introduce calcium to a ferrous melt when magnesium additions are made in order to suppress the usual violent reaction which accompanies the submersion of magnesium in the molten bath and to increase the effectiveness of the magnesium in the nodularizing process.

Heretofore, it has been proposed to add calcium metal (often in the form of a silicide) as a final ladle addition after the smelting of a ferrosilicon alloy, however, use of calcium metal is quite expensive. It has also been proposed to charge calcium carbonate in the form of lump limestone directly in the smelting furnace, but it has been found difficult to closely control the final calcium content to desired levels during the smelting of ferrosilicon alloys due to the fact calcium has high affinity to react with silica in the furnace charge to form a slag. Such slag compounds are difficult to reduce and require more expensive, higher furnace temperature operation and cause reduced furnace efficiency. Prior attempts to add calcium in the smelting furnace have produced an unacceptable wide variation in final calcium content in the cast ferrosilicon alloy product which then requires a final calcium metal addition in the ladle. Suffice it to say that prior practice has been inefficient and/or expensive.

The present invention solves the problem of achieving a desired calcium content in the production of ferrosilicon alloys in an economic and efficient manner by providing a novel method of introducing calcium to the smelting furnace and processing the calcium constituent therein. The present invention also provides a novel calcium oxide briquette which can be used with rare earth briquettes for practising the process. As a result, the present invention provides an efficient method of introducing the calcium and also rare earth constituents to a ferrosilicon alloy smelting furnace. Still further, the invention provides a method for closely controlling the final calcium content in a ferrosilicon cast alloy which minimizes the expensive high temperature ladle additions of calcium as practiced in the prior art.

SUMMARY OF THE INVENTION

Briefly stated, the present invention is directed to the production of silicon alloys and preferably ferrosilicon alloys having a controlled calcium content and a novel briquette for use therein. The method according to the invention comprises the steps of (a) charging a mixture of silica, carbon, and other known ingredients such as preferably iron into the top of a smelting furnace; (b) briquetting or otherwise forming a solid consolidated mixture of a finely divided mixture of calcium carbonate and carbon, preferably in the form of carbon black, and charging the briquettes so formed into the top of the smelting furnace; (c) heating the briquettes to thermally transform the calcium carbonate in the solid state to calcium oxide; (d) further heating and reacting the calcium oxide with the carbon in the briquette to form molten calcium carbide; (e) reacting the calcium carbide with the silica to form calcium silicide in solution in the molten ferrosilicon alloy; (f) tapping the molten ferrosilicon alloy having a controlled calcium content into a ladle for a magnesium addition; and (g) casting the alloy mixture into ingot form for later use in a foundry operation or the like. In addition, the present invention also contemplates the addition of rare earth oxides in briquette form consisting of one or more of the lanthanide series elements, including Ce, La, Ne and the like.

The calcium carbonate material forming the novel briquette of the invention is a finely divided powder, preferably limestone, less than 325 mesh screen size. The carbon source is preferably carbon black, preferably agglomerated into fine pelletized form prior to mixing with the calcium carbonate. A binder such as a powdered lignin material or molasses is also preferably added to the carbon black-calcium carbonate mixture to impart strength to the briquette. A typical ferrosilicon alloy ladle analysis in accordance with the present invention consists of about 48-51% Si, about 0.4% to about 2.4% Ca, 0 to about 1.4% Ce, 0 to about 2.25% total rare earth constituents including cerium, about 0.5 to 1.5% Al, and the balance iron.

DETAILED DESCRIPTION OF THE INVENTION

In the conventional production of ferrosilicon alloys, it is common practice to process a solid charge of silica ($SiO_2$) in the form of quartz, for example, mixed with carefully sized coal as a carbon source, scrap iron and wood chips. The wood chips are a source of carbon and also act as an electrical insulator prior to converting to charcoal and function as a bulking agent to permit gases to escape therethrough. The conventional ferrosilicon alloy smelting furnace includes carbon electrodes for generating an arc heated smelting zone which forms a molten pool in a bottom portion of the furnace. Solid charge materials descend downwardly from a top charging zone whereupon they are heated, fused and reacted. The principal smelting reaction is the reduction of silica in the presence of carbon and iron to form a ferrosilicon alloy solution:

$$SiO_2 + 2C \rightarrow Si + 2CO \quad (1)$$

$$Si + Fe \rightarrow FeSi \text{ alloy} \quad (2)$$

In order to minimize the undesirable side reactions which are present when calcium carbonate is added to the top of the furnace, we have discovered that a controlled calcium composition can be obtained if the calcium carbonate is first mixed with carbon and introduced into the smelting furnace in briquette form. Calcium carbonate powder preferably in the form of limestone is mixed with a particulate carbon source such as carbon black, coal, coke or charcoal and pressed into briquettes, in a weight ratio based on the overall reaction:

$$CaCO_3 + 4C \rightarrow CaC_2 + 3CO \quad (3)$$

and thereby minimize undesirable side reaction in the upper zone of the smelting furnace. According to reaction (3) above, at least four mols of carbon are required to react with one mol of calcium carbonate to form one mol of calcium carbide.

As the charged briquette descends with the other solid charge materials, i.e., quartz, coal, scrap iron and wood chips, into the hotter, lower region of the smelting furnace, reaction (3) is considerably aided by a prior thermal dissociation of calcium carbonate into calcium oxide. This thermal dissociation of calcium carbonate occurs within the solid state briquettes at about 1650° F. according to the following:

$$CaCO_3 + Heat \rightarrow CaO + CO_2 \quad (4)$$

The original carbon content of the briquette, after equation (4) is now in considerable excess of the required amount for reaction (5) (on the order of about 35% excess). The carbon reacts with the formed CaO to produce the desired calcium carbide ($CaC_2$) at about 3,488° F., according to the reaction:

$$CaO + 3C \rightarrow CaC_2 + CO \quad (5)$$

The molten calcium carbide ($CaC_2$) in the liquid smelting zone of the furnace then is introduced into the ferrosilicon alloy according to the following reaction:

$$2SiO_2 + CaC_2 + 2C \rightarrow CaSi_2 + 4CO \quad (6)$$

The above reactions are believed to take place although the dynamics of the smelting furnace may involve reactions and kinetics which vary from the defined reactions. The molten melt in the smelting zone of the furnace then contains an alloy mixture of iron, silicon and calcium in solution, plus any other constituents added such as rare earth (RE) additives and incidental impurities. The molten mixture is then tapped from the bottom of the smelting furnace and poured into a ladle where further additions such as magnesium are made.

The finished ferrosilicon alloy castings containing closely controlled amounts of calcium and rare earth constituents (if used) plus magnesium are then suitable for direct addition to the foundry furnace in the production of nodular cast iron.

These briquettes may also be used to form calcium silicon alloys as shown by equation (6), where $CaSi_2$ is formed by the reaction of the silica and the calcium carbide. While different sources of carbon, such as coal, can be employed in making the briquettes, we presently prefer to use highly reactive carbon black as the carbon source. Carbon black having a carbon content of +99% is first agglomerated into pellets of micron size and mixed with finely divided limestone. The limestone preferably contains greater than 95% calcium carbonate and is pulverized to 75% finer than 325 mesh screen size; although other purities and particle sizes may be employed. Goulac brand powdered lignin binder is preferably employed to produce a briquette with good handling and furnacing characteristics. Additions of small amounts of hydrated lime, up to about 5 weight % may be used in order to hasten the curing of the air dried briquettes. A molasses binder may also be used as well as other known binder systems. A presently preferred briquette formulation contains about:

28% by weight carbon black
60% by weight pulverized limestone
7% lignin binder
5% hydrated lime The above ingredients are mixed along with water in a pin mixer and then processed in a briquette press, preferably a roll press, to produce compacted briquettes of convenient size, such as:

(a) $4\frac{1}{2}'' \times 1\frac{7}{8}'' \times 1\frac{1}{2}''$; or
(b) $2\frac{1}{4}'' \times 1\frac{1}{2}'' \times \frac{3}{4}''$ The briquettes are air dried for several days in piles to gain cure strength for handling purposes.

The smaller briquette, (b) above, is stronger and less prone to breakage in handling, however, the larger size (a) is more economical to produce.

Rare earth (RE) briquettes are produced in a similar manner and contain a mixture of naturally occurring rare earth oxides, in ore form, containing predominantly cerium oxide, along with other lanthanide series elements such as La, Ne and the like. The finely divided rare earth ore is mixed with a binder such as lignin binder made slightly acidic to be compatible with the RE component. Water is added to make the mix somewhat plastic in consistency for pressing into briquette form. The RE briquettes are dried in air and thereafter assume a suitable cured strength. The RE briquettes are charged into the upper zone of the smelting furnace and descend along with the other charged materials. The RE oxides are heated and later are reduced by reaction with the free carbon present in the furnace coal charge to permit the RE constituents to enter into solution in elemental form with the molten ferrosilicon alloy.

Other forms of consolidated mixtures of calcium carbonate and carbon can be employed. For example, such consolidated mixtures can be formed by pelletizing, extruding, agglomerating and the like.

A comparison of a smelting furnace melt without the briquettes and a melt prepared utilizing the process of the present invention is reported in Table I.

TABLE I

| Calcium briquette addition lb/batch | RE briquette addition lb/batch | Alloy composition % | | | | |
|---|---|---|---|---|---|---|
| | | Si | Ca | Ce | RE | Al |
| — | 30 | 50.01 | 0.43 | 0.48 | 0.93 | 0.45 |
| 190 | 65 | 49.52 | 1.98 | 1.10 | 2.09 | 0.83 |

The alloy compositions reported in Table I are the as tapped compositions and do not reflect the later composition modifications made in the ladle, such as the magnesium additions. The 0.43 Ca in the melt without the calCium briquette addition is the residual calcium carried over from the previous melt. The results indicate, however, that close control of calcium and RE compositions are possible when the briquetting techniques of the present invention are employed.

Utilization of calcium-magnesium ferrosilicon alloys made in accordance with the invention have resulted in an increased magnesium recovery of between 30 and 80% as compared to such alloys made with conventional ladle additions of calcium. Therefore, less addition of the final product is required by the end user.

What is claimed is:

1. A briquette for use in smelting a ferrosilicon alloy containing a controlled amount of calcium, said briquette comprising a compressed mixture consisting essentially of about 60% by weight finely divided particles of calcium carbonate, about 28% by weight carbon black, about 7% by weight lignin binder and about 5% by weight hydrated lime.

2. A method of producing a calcium containing ferrosilicon alloy containing a controlled amount of calcium comprising:

(a) preparing a mixture of a finely divided calcium carbonate powder of a size where 75% of the powder is on the order of less than 325 mesh screen size, a carbon source of micron size and a binder and compressing the mixture to form a plurality of briquettes;

(b) charging the briquettes to a smelting furnace containing a charge of materials including silica, iron and carbon containing materials;

(c) heating the briquettes to cause a reaction between the calcium and carbon in the briquette to produce calcium carbide;

(d) reacting the calcium carbide with a portion of the silica in the furnace to produce a calcium silicide;

(e) forming a calcium silicide solution with a molten ferrosilicon alloy being formed in the furnace; and (f) tapping the molten ferrosilicon alloy from the smelting furnace whereby said alloy contains a controlled amount of calcium therein.

3. The method of claim 2 wherein said mixture includes a carbon source selected rom the group consisting of carbon black, coke, coal and charcoal.

4. The method of claim 2 wherein the mixture includes a binder selected from one of the group consisting of lignin and molasses.

5. The method of claim 2 including the steps of preparing a mixture of a rare earth oxide ore and a binder; briquetting said mixture and charging said rare earth oxide briquettes into the smelting furnace whereby said rare earth oxides are reduced by the carbon in the furnace charged materials and the said rare earth constituents are thereafter introduced into the molten ferrosilicon alloy.

6. The briquette of claim 2 including an effective amount of hydrated lime to hasten a curing of the briquettes.

7. A ferrosilicon alloy produced in accordance with the method of claim 2.

* * * * *